US005717287A

United States Patent [19]

Amrine et al.

[11] Patent Number: 5,717,287

[45] Date of Patent: Feb. 10, 1998

[54] SPACERS FOR A FLAT PANEL DISPLAY AND METHOD

[75] Inventors: Craig Amrine, Tempe; Kenneth Dean, Phoenix, both of Ariz.

[73] Assignee: Motorola, Schaumburg, Ill.

[21] Appl. No.: 691,739

[22] Filed: Aug. 2, 1996

[51] Int. Cl.[6] ..... H01J 31/00

[52] U.S. Cl. ..... 313/495; 313/496; 445/24

[58] Field of Search ..... 313/495, 496, 313/497, 336, 422, 477 R; 445/24; 65/40

[56] References Cited

U.S. PATENT DOCUMENTS 5,232,549 8/1993 Cathey et al. ..... 445/24 X 5,634,585 6/1997 Stansbury ..... 445/24 X

*Primary Examiner*—Nimeshkumar Patel

*Attorney, Agent, or Firm*—Eugene A. Parson

[57] ABSTRACT

A method for affixing a plurality of spacers (150, 250) within a field emission display (100, 200) is disclosed. The method includes the steps of: (i) forming a metallic bonding pad (160, 260) on the inner surface of the anode (110) or cathode (230) (ii) placing an edge of the spacers (150, 250) in intimate physical contact with a portion of the metallic bonding pad (160, 260) thereby providing contacting surfaces (iii) applying a potential difference of about 1000 Volts across the contacting surfaces so that the metallic bonding pad (160, 260) is biased positively with respect to the spacers (150, 250), and (iv) simultaneously heating the region about, and including, the bonding surfaces to a temperature of about 400 degrees Celsius for about 15 minutes so that an anodic bond is formed between the contacting surfaces.

19 Claims, 4 Drawing Sheets

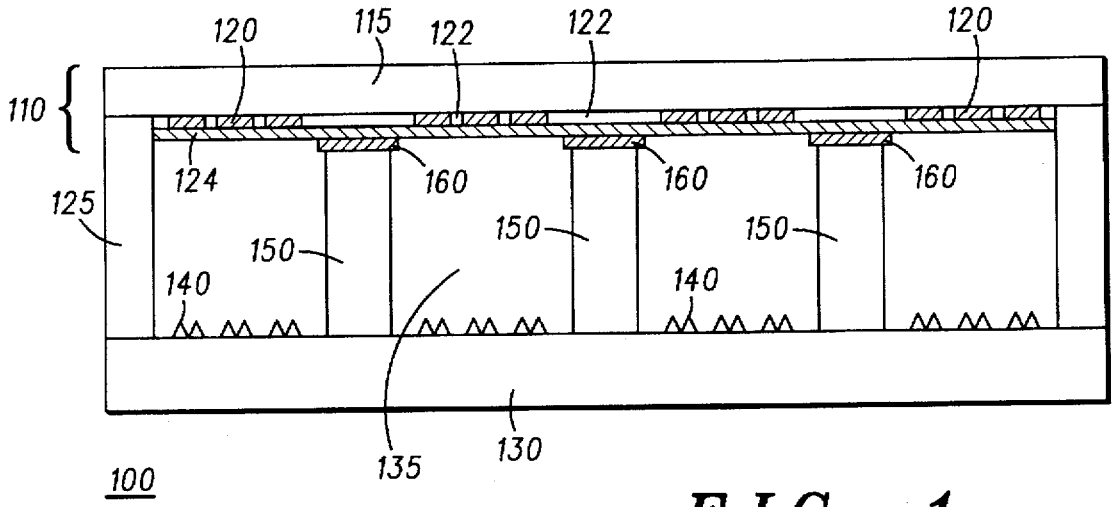
FIG. 1
FIG. 2
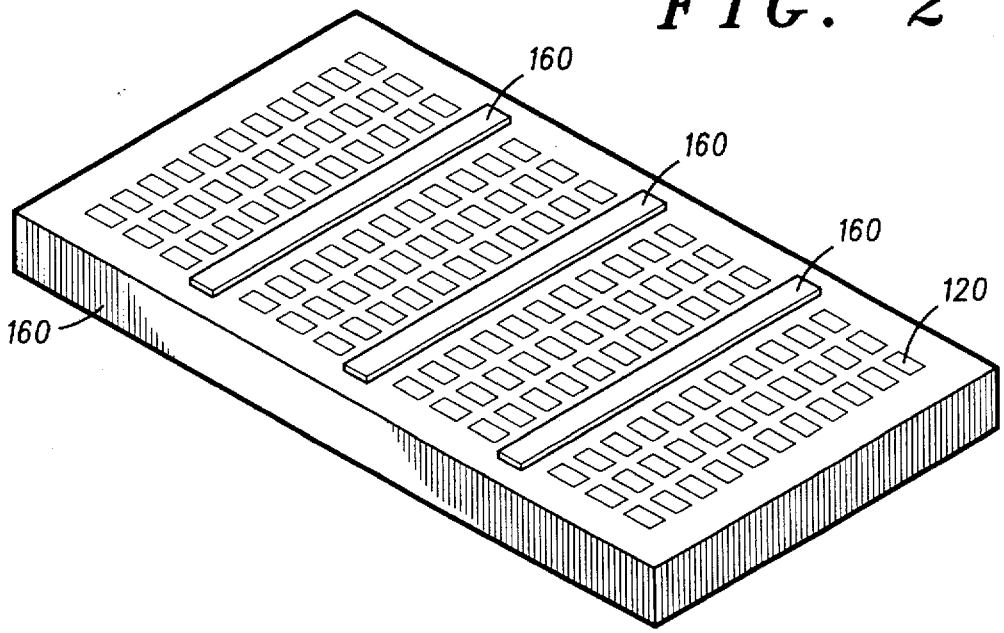

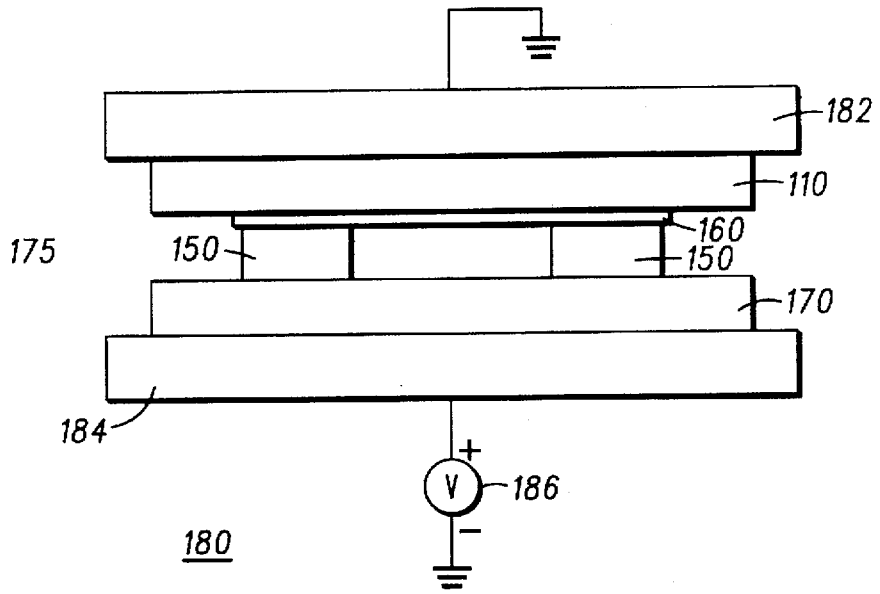
FIG. 5
FIG. 6
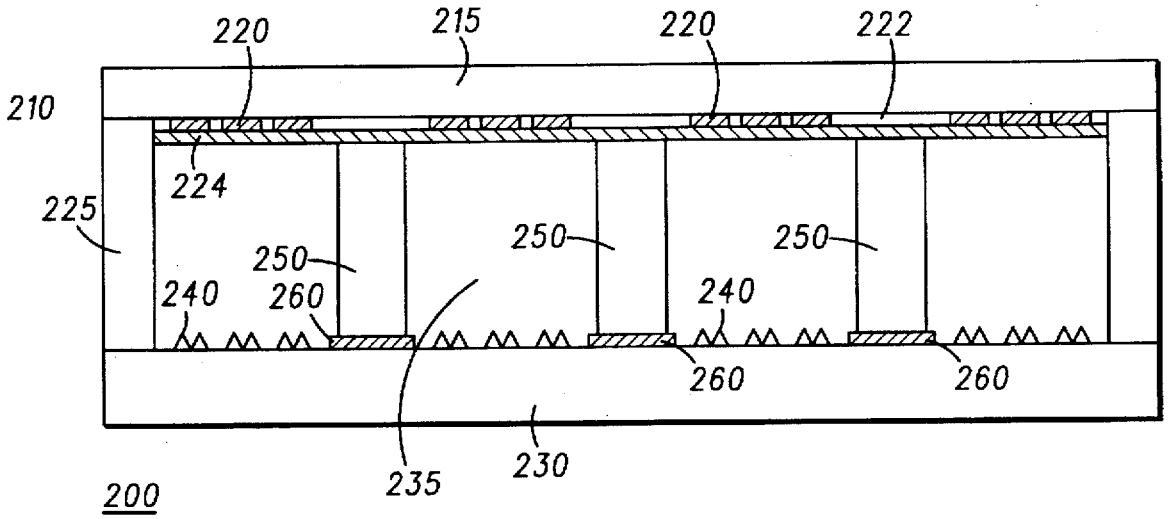

SPACERS FOR A FLAT PANEL DISPLAY AND METHOD

FIELD OF THE INVENTION

The present invention pertains to a method for providing spacers in a flat panel display and more specifically to a method for using anodic bonding to affix spacers within a flat panel display.

BACKGROUND OF THE INVENTION

Spacers for flat panel displays, such as field emission displays, are known in the art. A field emission display includes an envelope structure having an evacuated interspace region between two display plates. Electrons travel across the interspace region from a cathode plate (also known as a cathode or back plate), upon which electron-emitter structures, such as Spindt tips, are fabricated, to an anode plate (also known as an anode or face plate), which includes deposits of light-emitting materials, or "phosphors". Typically, the pressure within the evacuated interspace region between the cathode and anode plates is on the order of $10^{-6}$ Torr.

The cathode plate and anode plate are thin in order to provide low display weight. If the display area is small, such as in a 1" diagonal display, and a typical sheet of glass having a thickness of about 0.04" is utilized for the plates, the display will not collapse or bow significantly. However, as the display area increases, the thin plates are not sufficient to withstand the pressure differential in order to prevent collapse or bowing upon evacuation of the interspace region. For example, a screen having a 30" diagonal will have several tons of atmospheric force exerted upon it. As a result of this tremendous pressure, spacers play an essential role in large area, light-weight displays. Spacers are structures being incorporated between the anode and the cathode plate. The spacers, in conjunction with the thin, lightweight, plates, support the atmospheric pressure, allowing the display area to be increased with little or no increase in plate thickness.

Several schemes have been proposed for providing spacers. Some of these schemes include the affixation of glass rods or posts to one of the display plates by applying a solder glass frit to one end of the rod or post and bonding the frit to the inner surface of one of the display plates. This scheme includes problems such as bond brittleness, particulate contamination, and smearing onto pixels. Other proposed schemes for bonding spacers onto a display plate include the use of organic glues. However, organic glues are burned off before the package has been sealed and differential pressure applied thereby allowing the spacers to become detached and misplaced within the envelope of the display.

Thus, there exists a need for a method for affixing spacers within s flat panel display which is compatible with the clean, high vacuum environment within a field emission display and which provides an irreversible, inert bond.

BRIEF DESCRIPTION OF THE DRAWINGS

Referring to the drawings:

FIG. 1 is a cross-sectional view of an embodiment of a field emission display including spacers in accordance with the present invention.

FIGS. 2, 3 and 4 are isometric views of structures realized by performing various steps of an embodiment of a method for affixing spacers in a flat panel display in accordance with the present invention.

FIG. 5 is a side-elevational view an apparatus suitable for use in performing various steps of an embodiment of a method for affixing spacers in a flat panel display in accordance with the present invention.

FIG. 6 is a cross-sectional view of another embodiment of a field emission display including spacers in accordance with the present invention.

DESCRIPTION OF THE PREFERRED EMBODIMENT

Figure 3:
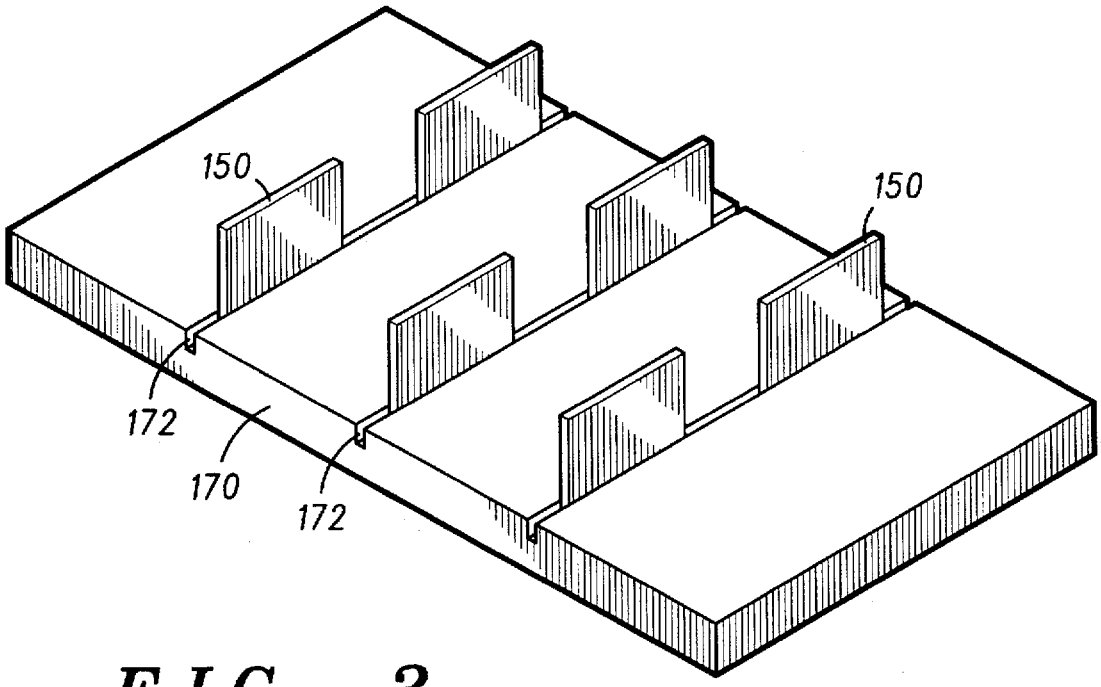

Referring now to FIG. 1, there is depicted a cross-sectional view of a field emission display (FED) 100 in accordance with the present invention. FED 100 includes an anode display plate 110 and a cathode display plate 130, which has an inner surface that is spaced from and opposes the inner surface of anode display plate 110. A plurality of side walls 125 are located at the perimeters of anode display plate 110 and cathode display plate 130 and extend therebetween to maintain a predetermined spacing between the inner surfaces of anode display plate 110 and cathode display plate 130. This predetermined spacing is on the order of 0.2–1 millimeters and depends upon the magnitude of the potential difference between anode display plate 110 and cathode display plate 130 during the operation of FED 100. Anode display plate 110, cathode display plate 130, and side walls 125 are made from a suitable hard material such as glass and further define an envelope 135 which is evacuated to include a vacuum on the order of $1\times^{10-6}$ Torr or less. Anode display plate 110 includes a glass substrate 115 having a major surface. A plurality of phosphor (cathodoluminescent) deposits 120 are deposited on the major surface of anode display plate 110. A black surround layer 122 is also provided on the major surface of anode display plate 110 between phosphor deposits 120. Black surround layer 122 is made from suitable contrast enhancement materials, such as chrome oxide and chrome. A thin layer 124 of aluminum is deposited, using one of a number of standard metal film deposition techniques, over black surround layer 122 and phosphor deposits 120. Layer 124 has a thickness of about 700 Angstroms. Layer 124 serves as an optical reflector and can also serve as a charge bleed-off layer for bleeding off excessive electrical charge that may accumulate on anode display plate 110. Cathode display plate 130 includes a plurality of field emitters 140 also disposed within envelope 135. Field emitters 140 are made from a suitable electron-emissive material. Suitable electron-emissive materials include molybdenum, niobium, tungsten, hafnium, silicon, and carbon. Cathode display plate 130 and anode display plate 110 also include the appropriate electronics, known to one skilled in the art, for extracting electrons from, and selectively addressing, field emitters 140. FED 100 further includes a plurality of spacers 150 which extend between cathode display plate 130 and anode display plate 110 for maintaining the predetermined spacing therebetween. Spacers 150 are located within envelope 135. Spacers 150 include glass plates having a width within a range of 25–250 micrometers and a height within a range of 0.2–3 millimeters. In this particular embodiment, spacers 150 are made from soda-lime silicate glass, and the substrates of anode display plate 110 and cathode display plate 130 are also made from soda-lime silicate glass. Another suitable glass from which spacers 150 can be made is borosilicate glass, which is known to form anodic bonds with the appropriate materials. In this particular embodiment, because they are all made from the same materials, spacers 150, anode display plate 110, and cathode display plate 130 have thermal expansion coefficients which are equal, thereby preventing breakage due to variable expansion rates of FED 100 during thermal processing. In other embodiments, different materials are used for spacers 150 and display plates 110, 130; these materials, however, must have thermal expansion coefficients which are substantially the same to prevent breakage and cracking during thermal cycles in the fabrication of FED 100. Also, in other embodiments of the present invention, the spacers include structures other than thin plates, such as rods, posts, fibers, and balls. In the particular embodiment of FIG. 1, anode display plate 110 and cathode display plate 130 each have a thickness of about 1.1 millimeters. The necessary configuration of spacers 150 within envelope 135 is dependent upon these thicknesses. For a thickness of 1.1 millimeters, a distance between adjacent spacers of about 15 millimeters is suitable. Spacers 150 also have opposed edges which physically contact anode display plate 110 and cathode display plate 130. Also included on anode display plate 110 are a plurality of metallic bonding pads 160 made from aluminum and disposed between phosphor deposits 120. Metallic bonding pads 160 are formed by selectively depositing aluminum onto layer 124 by using one of a number of standard metal film deposition techniques, known to one skilled in the art. Metallic bonding pads 160 are disposed at those locations on anode display plate 110 where it is desired to bond spacers 150. The thickness of metallic bonding pads 160 is in a range of 0.05–5 micrometers. In other embodiments in accordance with the present invention, spacers 150 are bonded directly to the aluminum of layer 124, which thereby comprises the metallic bonding pads. In the particular embodiment of FIG. 1, the added aluminum of metallic bonding pads 160 is believed to provide a stronger bond as well as added compliance. Compliance at the region of the bond prevents cracking and breakage by compensating for variation in the height of spacers 150 and for variation in the coefficient of thermal expansion between spacers 150 and anode display plate 110, when they are made from different materials. One edge of each of spacers 150 is anodically bonded to a portion of metallic bonding pads 160; the opposing edge of each of spacers 150 is in abutting engagement with a portion of the inner surface of cathode display plate 130, between plurality of field emitters 140.

Figure 4:
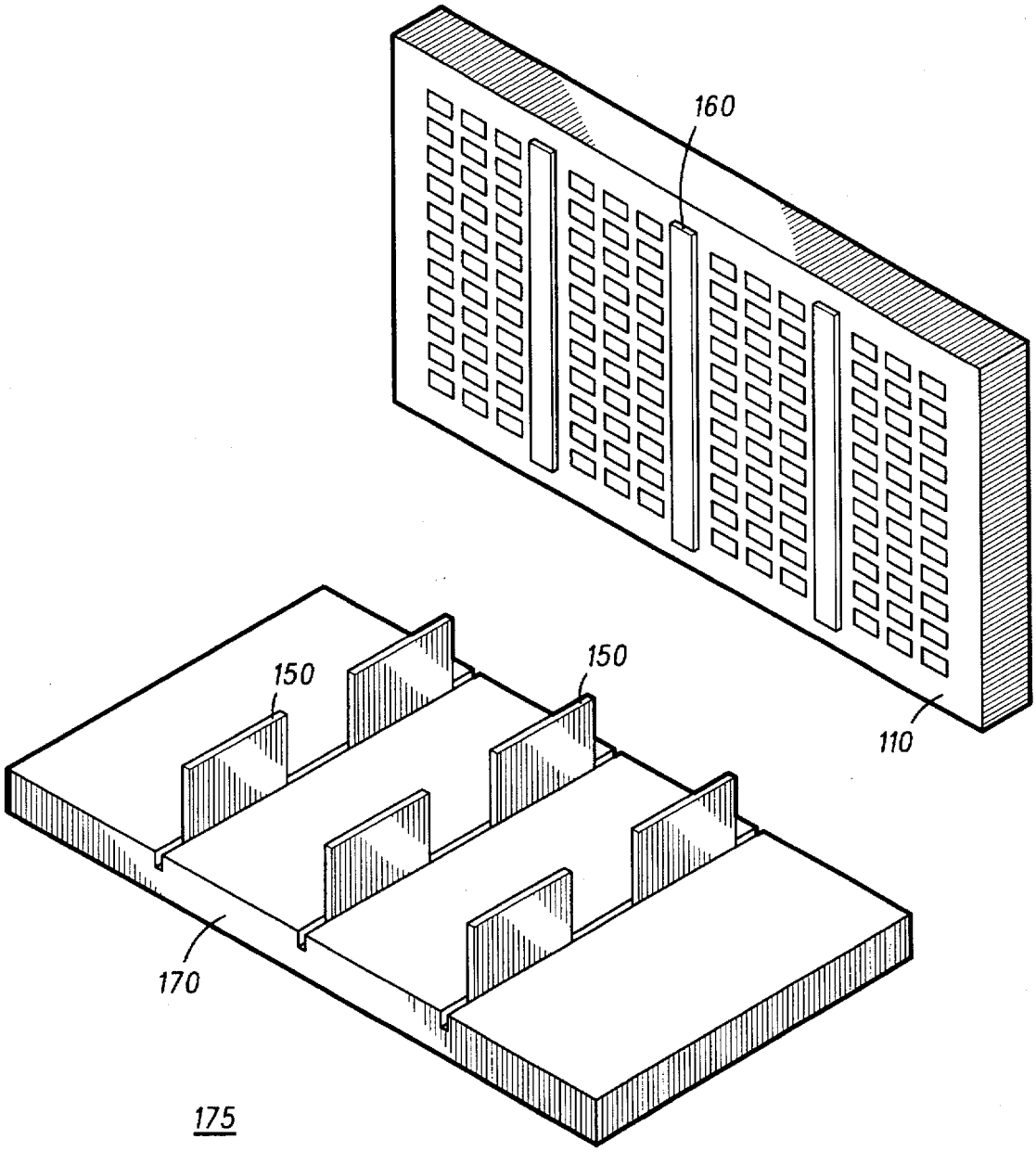

Referring now to FIGS. 2–4 there are depicted isometric views of structures realized by performing various steps of an embodiment of a method for affixing spacers 150 in FED 100 in accordance with the present invention. Depicted in FIG. 2 is anode display plate 110 after metallic bonding pads 160 have been formed by selectively depositing aluminum metal thereon. The aluminum of metallic bonding pads 160 is deposited between predetermined phosphor deposits 120 at those locations where it is desired to position spacers 150. In this particular embodiment, metallic bonding pads 160 include strips of aluminum extending the length of anode display plate 110; in other embodiments they include shorter strips, dots, or layers. The surface of metallic bonding pads 160, against which an edge of each of spacers 150 is subsequently positioned in intimate physical contact, must substantially conform to the surface of the contacting edge of spacers 150. These surfaces substantially conform when the extent of subsequent bonding at the contacting surfaces is sufficient to permanently attach spacers 150 to anode display plate 110 and maintain spacers 150 in a perpendicular orientation with respect to the inner surface of anode display plate 110. Substantial conformation precludes bonding of only a portion or portions of the contacting edge of each spacer. Providing uniform perpendicularity among spacers 150 is important to assure that all spacers 150 subsequently make physical contact, at their opposing second edges, with the inner surface of cathode display plate 130 and can thereby bear the load due to atmospheric pressure. Referring now to FIG. 3 there is depicted a jig 170 suitable for use for positioning spacers 150 perpendicularly with respect to anode display plate 110 during the step of forming anodic bonds between the contacting surfaces of the edges of spacers 150 and the physically contacted portions of metallic bonding pads 160. Jig 170 also maintains spacers 150 in an appropriate layout during the subsequent bonding steps. Jig 170 includes a plurality of suitably spaced slots 172 into which the non-bonding edges of spacers 150 are inserted. The slots are deep enough, and of suitable width, to maintain spacers 150 in an upright, perpendicular position. Then, a structure 175, as illustrated in FIG. 4, is provided by placing anode display plate 110 in abutting engagement with the first edges of spacers 150 so that the physically contacting surfaces include the first edges of spacers 150 and portions of metallic bonding pads 160. In this particular embodiment, the contacting surfaces of metallic bonding pads 160 substantially conform to the first edges of spacers 150 because the exposed surface of the deposited aluminum is flat, and the first edges of spacers 150 are also flat. Thus, during the subsequent bonding steps, bonding occurs over the entire surface of the first edges of spacers 150. Other methods of holding spacers 150 in an appropriate orientation with respect to anode display plate 110 during the bonding steps, will occur to one skilled in the art.

Referring now to FIG. 5, there is depicted a side elevational view of an apparatus 180 suitable for use in performing various steps of a method for affixing a plurality of spacers within a flat panel display in accordance with the present invention. Apparatus 180 includes a fixture 182 for holding anode display plate 110 of structure 175 (FIG. 4) which is connected to ground. Apparatus 180 further includes a conductive plate 184 which is electrically coupled to a voltage source 186. Jig 170, containing spacers 150, is placed upon conductive plate 184. Spacers 150 are in physical contact with metallic bonding pads 160. A potential difference within a range of 500–2000 volts, and preferably 1000 volts, is applied over apparatus 180 thereby providing the potential difference over the contacting surfaces of spacers 150 and metallic bonding pads 160. The voltage is applied so as to positively bias metallic bonding pads 160 with respect to spacers 150. Concurrent with the step of applying the potential difference, and in accordance with the present invention, structure 175 is heated in an oven to a temperature within a range of 300–500 degrees Celsius, preferably about 400 degrees Celsius. At 1000 volts and about 400 degrees Celsius, the duration of the bonding steps is about 15 minutes. The suitable bonding time is determined by the value of the potential difference and the temperature to which the contacting surfaces are heated and is sufficient to form an anodic bond at each of the pairs of contacting surfaces. At the elevated temperature, ionic mobility within the glass of spacers 150 increases drastically. The ions within the glass include $Na^+$ and $O^{2-}$. The applied potential causes these mobile ions to diffuse within the glass. Metal-to-glass bonding occurs at the contacting surfaces by first establishing a high electrostatic field at the glass/metal interface. This is made possible due to the low diffusivity of aluminum cations, $Al^{2+}$ and $Al^{3+}$, in glass. Cations, such as $Na^+$, within the glass migrate away from the contacting surface effectively polarizing the glass in a region of the glass near the interface. Strong electrostatic forces develop between the glass and aluminum, pulling spacers 150 into intimate contact with metallic bonding pads 160. Cations within metallic bonding pads 160 then diffuse into the glass to compensate for the charge imbalance in the sodium depleted region. Concurrently, non-bridging oxygen ion in the glass migrate toward the aluminum surface, thereby forming a strong, irreversible, and chemically inert anodic bond. Other suitable metals may be used for metallic bonding pads 160; a suitable metal provides cations that have diffusivities in glass which are low enough to allow high electrostatic forces to develop before the cations commence migration into the glass. Such suitable metals include iron, nickel, chromium, silicon, and aluminum. Silver is not a suitable bonding metal. After a suitable bonding time has elapsed, the applied potential difference is removed and the structure is cooled. Anode display plate 110 is lifted away from jig 170. Since spacers 150 are now affixed to anode display plate 110, they are lifted out of jig 170. Field emission display 100 (FIG. 1) is then formed by positioning the inner surface of cathode display plate 130 in abutting engagement with the second, non-bonding edges of spacers 150. A plurality of side walls 125 are also provided between anode display plate 110 and cathode display plate 130 at their perimeters to provide an envelope 135. Envelope 135 is evacuated to provide a vacuum therein of about $1\times10^{-6}$ Torr or less. The necessary electronics (not shown) are also provided for extracting electrons from field emitters 140 and selectively addressing field emitters 140, which will be apparent to one skilled in the art.

Referring now to FIG. 6, there is depicted a field emission display (FED) 200 in accordance with the present invention. FED 200 includes an anode display plate 210 having an inner surface having a plurality of phosphor deposits 220 formed thereon, a cathode display plate 230 having an inner surface including a plurality of field emitters 240 disposed thereon, a plurality of side walls 225, and a plurality of spacers 250. The materials and dimensions of the elements of FED 200 are the same as the materials and dimensions of the analogous elements of FED 100 (FIG. 1), which are similarly referenced, beginning with a "1", Side walls 225 are disposed between anode display plate 210 and cathode display plate 230 at their perimeters to provide standoff and maintain a predetermined spacing therebetween. Spacers 250 provide a similar function within the active region of FED 200. In this particular embodiment, a plurality of metallic bonding pads 260 are formed on the inner surface of cathode display plate 230, on the regions between field emitters 240, so as to reduce interference with the functioning of field emitters 240. In a method for fabricating FED 200 in accordance with the present invention, the bonding first edges of spacers 250 are physically contacted with metallic bonding pads 260 and then bonded thereto in the manner described with reference to FIGS. 2–5. Field emitters 240 are typically made from a metal, such as molybdenum. In this particular embodiment, to prevent oxidation of field emitters 240, the bonding steps (including heating and applying a potential difference over the contacting surfaces as described with reference to FIG. 5) must be performed in an inert atmosphere, such as an argon or nitrogen atmosphere, which does not contain oxygen, or a high vacuum environment. Also during the bonding steps, all components of cathode display plate 230 are preferably electrically coupled to maintain a uniform voltage throughout cathode display plate 230. This prevents the formation of potential differences within cathode display plate 230 which may cause extreme arcing between, and the resulting destruction of, the conductive rows and columns which are used to selectively address field emitters 240. Potential differences within cathode display plate 230 at the high bonding temperatures may also cause ionic migrations within the dielectric layers (not shown) within cathode display plate 230. These ionic migrations may damage the dielectric properties of those dielectric layers. One of the benefits of the present invention is this ability to affix the spacers to the cathode display plate, which is not feasible when using fritting methods; the process of bonding with a frit requires an oxidizing atmosphere, which is detrimental to field emitters 240. Another benefit of this particular embodiment is that it provides a metal layer at the interface between spacers 250 and cathode display plate 230. This metal layer can provide a path for bleeding off electrical charge which accumulates on spacers 250 during the operation of FED 200. Excessive accumulated charge on spacers 250 alters the nature of the electric field within the evacuated regions adjacent spacers 250, thereby distorting electron trajectories in these regions.

While we have shown and described specific embodiments of the present invention, further modifications and improvements will occur to those skilled in the art. We desire it to be understood, therefore, that this invention is not limited to the particular forms shown, and we intend in the appended claims to cover all modifications that do not depart from the spirit and scope of this invention.

What is claimed is:

1. A flat panel display comprising:

a first display plate having a major surface and a perimeter;

a second display plate having a major surface and a perimeter, the major surface of the second display plate being spaced from and opposing the major surface of the first display plate;

a plurality of side walls extending between the first and second display plates at their perimeters;

the first and second display plates and the plurality of side walls defining an envelope, the envelope being evacuated, the envelope further having a plurality of phosphor deposits and a plurality of field emitters therein;

a thin layer of bonding metal being disposed on the major surface of the first display plate and within the envelope, the bonding metal being selected from a group consisting of aluminum, iron, nickel, chromium, and silicon; and a spacer being made from glass and having first and second opposed edges, the first opposed edge of the spacer being anodically bonded to a portion of the thin layer of bonding metal, the second opposed edge being in abutting engagement with the major surface of the second display plate.

2. A flat panel display as claimed in claim 1 wherein the spacer has a height within a range of 0.2–3 millimeters and a width within a range of 25–250 micrometers.

3. A flat panel display as claimed in claim 1 wherein the glass includes soda-lime silicate glass.

4. A flat panel display as claimed in claim 1 wherein the first display plate has a first thermal expansion coefficient and the spacer has a second thermal expansion coefficient, the first thermal expansion coefficient being substantially equal to the second thermal expansion coefficient.

5. A flat panel display as claimed in claim 1 wherein the thin layer of bonding metal has a thickness within a range of 0.05–5 micrometers.

6. A flat panel display as claimed in claim 1 wherein the major surface of the first display plate includes the plurality of phosphor deposits disposed thereon and wherein the major surface of the second display plate includes the plurality of field emitters disposed therein, the plurality of phosphor deposits being designed to receive electrons emitted by the plurality of field emitters thereby providing a flat panel field emission display.

7. A flat panel display as claimed in claim 1 wherein the major surface of the first display plate includes the plurality of field emitters disposed therein and wherein the major surface of the second display plate includes the plurality of phosphor deposits disposed thereon, the plurality of phosphor deposits being designed to receive electrons emitted by the plurality of field emitters thereby providing a flat panel field emission display.

8. A method for affixing a plurality of spacers within a flat panel display having first and second display plates each having a major surface, the display further including a plurality of phosphor deposits and a plurality of field emitters, the method including steps of:

providing a plurality of spacers having first and second edges;

forming a metallic bonding pad on the major surface of the first display plate;

physically contacting the first edge of each spacer with a portion of the metallic bonding pad to provide a plurality of pairs of contacting surfaces; and applying a potential difference within a range of 500–2000 volts over the plurality of pairs of contacting surfaces, the metallic bonding pad being biased positively with respect to the plurality of spacers; and concurrent with the step of applying the potential difference, heating the plurality of pairs of contacting surfaces to a temperature within a range of 300–500 degrees Celsius for a period of time sufficient to form an anodic bond at each of the plurality of pairs of contacting surfaces.

9. A method for affixing a plurality of spacers within a flat panel display as claimed in claim 8 wherein the contacting surfaces substantially conform to one another.

10. A method for affixing a plurality of spacers as claimed in claim 8 wherein the first display plate includes the plurality of field emitters and wherein the steps of applying a potential difference and heating the contacting regions are performed in an inert atmosphere thereby preventing oxidation of the plurality of field emitters.

11. A method for affixing a plurality of spacers as claimed in claim 10 further including, concurrent with the steps of applying a potential difference and heating the contacting regions, the step of maintaining all portions of the first display plate at a predetermined potential thereby preventing undesired arcing and ion migration within the portions of the first display plate.

12. A method for affixing a plurality of spacers as claimed in claim 8 wherein the plurality of field emitters are made from an electron-emissive material being selected from a group consisting of molybdenum, niobium, tungsten, hafnium, silicon, and carbon.

13. A method for affixing a plurality of spacers as claimed in claim 8 wherein the metallic bonding pad is made from aluminum.

14. A method for affixing a plurality of spacers as claimed in claim 13 wherein the metallic bonding pad has a thickness within a range of 0.05–5 micrometers.

15. A method for fabricating a flat panel display having a plurality of field emitters and a plurality of phosphor deposits including steps of:

providing first and second display plates each having a major surface and a perimeter;

providing a plurality of spacers having first and second edges;

forming a metallic bonding pad on the major surface of the first display plate;

physically contacting the first edge of each spacer with a portion of the metallic bonding pad to provide a plurality of contacting surfaces;

applying a potential difference with a range of 500–200 volts over the plurality of contacting surface, the metallic bonding pad being biased positively with respect to the plurality of spacers; and concurrent with the step of applying the potential difference, heating the plurality of contacting surfaces to a temperature within a range of 300–500 degrees Celsius for a period of time sufficient to form an anodic bond between the first edge of each spacer and the portion of the metallic bonding pad at each of the plurality of contacting surfaces;

positioning the second display plate in parallel spaced relationship to the first display plate, the major surface of the second display plate being in abutting engagement with the second edge of the plurality of spacers;

providing a plurality of side walls between the first and second display at their perimeters to provide an envelope; and evacuating the envelope.

16. A method for fabricating a flat panel display as claimed in claim 15 further including the steps of forming on the major surface of the first display plate the plurality of phosphor deposits and forming on the major surface of the second display plate the plurality of field emitters, the plurality of phosphor deposits being designed to receive electrons emitted by the plurality of field emitters thereby providing a flat panel field emission display.

17. A method for fabricating a flat panel display as claimed in claim 15 further including the steps of forming on the major surface of the first display plate the plurality of field emitters and forming on the major surface of the second display plate the plurality of phosphor deposits, the plurality of phosphor deposits being designed to receive electrons emitted by the plurality of field emitters thereby providing a flat panel field emission display.

18. A method for fabricating a flat panel display as claimed in claim 17 wherein the steps of applying a potential difference and heating the contacting regions are performed in an inert atmosphere thereby preventing oxidation of the plurality of field emitters.

19. A method for fabricating a flat panel display as claimed in claim 17 further including, concurrent with the steps of applying a potential difference and heating the contacting regions, the step of maintaining all portions of the first display plate at a predetermined potential thereby preventing undesired ion migration within the portions of the first display plate.

* * * * *